US010826233B1

(12) United States Patent
Yi et al.

(10) Patent No.: US 10,826,233 B1
(45) Date of Patent: Nov. 3, 2020

(54) RESILIENT LATCH WITH LOW STRESS CONCENTRATIONS

(71) Applicant: TE Connectivity Corporation, Berwyn, PA (US)

(72) Inventors: Chong Hun Yi, Mechanicsburg, PA (US); Richard C. Batley, III, York Springs, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/420,623

(22) Filed: May 23, 2019

(51) Int. Cl.
*H01R 13/627* (2006.01)
*H01R 43/26* (2006.01)

(52) U.S. Cl.
CPC ..... *H01R 13/6272* (2013.01); *H01R 13/6275* (2013.01); *H01R 43/26* (2013.01)

(58) Field of Classification Search
CPC . H01R 13/6272; H01R 13/6275; H01R 43/26
USPC ..... 439/345, 350, 357, 358
See application file for complete search history.

(56) References Cited

U.S. PATENT DOCUMENTS 6,402,573 B1 6/2002 Yeomans
6,450,830 B1 * 9/2002 Koseki ..... H01R 13/6275 439/352
6,712,635 B1 * 3/2004 Nimura ..... H01R 13/6272 439/352
6,799,898 B2 10/2004 Cheng et al.
6,860,750 B1 * 3/2005 Wu ..... H01R 13/6275 439/357
7,229,306 B2 * 6/2007 Mase ..... H01R 13/6272 439/354
7,530,838 B2 * 5/2009 Ohara ..... H01R 13/7031 439/489
7,682,181 B1 * 3/2010 Jones, Jr. ..... H01R 13/6272 439/352
8,292,652 B2 * 10/2012 Rohde ..... H01R 13/639 439/352
8,758,038 B2 * 6/2014 Kubo ..... H01R 13/6272 439/358
9,160,095 B2 * 10/2015 Littek ..... H01R 13/422
9,203,190 B2 * 12/2015 Hamai ..... H01R 13/639
9,577,382 B2 * 2/2017 Kida ..... H01R 13/641
9,583,876 B2 * 2/2017 Sekino ..... H01R 13/62933
9,791,086 B2 * 10/2017 De Beer ..... F16L 53/38
(Continued)

FOREIGN PATENT DOCUMENTS

WO 2010070396 A1 6/2010

*Primary Examiner* — Peter G Leigh

(57) ABSTRACT

An electrical connector having a latch which extends from the first housing surface of the housing. A mounting portion extends from the latch arm to the first housing surface. A first mounting surface of the mounting portion extends at a first angle from the first housing surface in a direction toward the mating connector latching end. The first mounting surface extends from the first latch arm surface at a second angle. The length of the mounting portion as measured between a vertex of the first angle and a vertex of the second angle along the first housing surface is greater than the distance that the first latch arm surface is spaced from the first housing surface. The latch arm is pivotable about the mounting portion. The latch and the mounting portion have low stress concentrations when the latch arm is pivoted about the mounting portion.

21 Claims, 3 Drawing Sheets

(56) References Cited

U.S. PATENT DOCUMENTS

| | | | | |
|---|---|---|---|---|
| 9,917,381 | B1 | 3/2018 | Campbell et al. | |
| 9,979,131 | B2 * | 5/2018 | Venkatesan | H01R 13/639 |
| 10,103,487 | B2 | 10/2018 | Holub | |
| 10,135,182 | B1 * | 11/2018 | Azad | H01R 13/6272 |
| 10,193,273 | B2 * | 1/2019 | Denz | H01R 13/6272 |
| 2002/0052135 | A1 * | 5/2002 | Noguchi | H01R 13/4367<br>439/352 |
| 2002/0072265 | A1 * | 6/2002 | Chen | H01R 13/6272<br>439/357 |
| 2004/0067676 | A1 * | 4/2004 | Nimura | H01R 13/6272<br>439/352 |
| 2015/0037998 | A1 * | 2/2015 | Kataoka | H01R 13/6683<br>439/357 |

* cited by examiner

RESILIENT LATCH WITH LOW STRESS CONCENTRATIONS

FIELD OF THE INVENTION

The present invention is directed to an a resilient latch for use with electrical connector. In particular, the latch has low stress concentrations when depressed thereby allowing the latch to be used with miniature connectors and connectors made of brittle plastic material.

BACKGROUND OF THE INVENTION

Electrical connector housings have been manufactured as one-piece plastics moldings with latch members integrally formed with terminal receiving body portions in the interests of simplicity with economy of manufacture and compactness.

In one well known electrical connector housing, the latch member comprises a lever arm integrally joined intermediate its ends to a side wall of the housing by a resilient web for pivotal movement between a release and a latching position, a latch portion of the lever arm extending forwardly of the web to protrude from a mating face of the housing and a finger engageable release portion of the lever arm extending rearwardly of the web and overlying the side wall. The web is located substantially midway along the length of the lever arm so that the latch and release portions are of equal length. Overstress stops having the form of longitudinal ribs are formed on a face of the release portions adjacent the side wall for engagement with the side wall on depressing the release portion towards the side wall to release the latch.

While the known latch members work well in many applications, the known latch members are prone to failure in applications where connector is molded from brittle material or where the connector is small or miniaturized. In these applications, the resilient web is prone to failure, as the pivoting action causes high stress concentrations which may lead to micro-cracks and the like at the pivot points.

It would, therefore, be beneficial to provide a latch which is configured to have low stress concentrations when depressed, thereby allowing the latch to be used with miniature connectors and connectors made of brittle plastic material over many cycles without failing.

SUMMARY OF THE INVENTION

An embodiment is directed to an electrical connector with a housing having a first housing surface. A latch extends from the first housing surface of the housing. The latch has a latch arm with a first latch arm surface which faces, but is spaced from the first housing surface. The latch arm has a mating connector latching end and a disengaging end. A mounting portion extends from the latch arm to the first housing surface. The mounting portion extends from the latch arm between the mating connector latching end and the disengaging end. A first mounting surface of the mounting portion extends at a first angle from the first housing surface in a direction toward the mating connector latching end. The first angle, as measured from the first housing surface nearer a mating end of the housing, is less than 90 degrees. The first mounting surface extends from the first latch arm surface at a second angle. The second angle, as measured from the first latch arm surface nearer a mating connector latching end, is greater than 90 degrees. The latch and the mounting portion do not fail when engaged as the latch and mounting portion have low stress concentrations when depressed.

An embodiment is directed to an electrical connector having a housing with a first housing surface. A latch extends from the first housing surface of the housing. The latch has a latch arm with a first latch arm surface which faces, but is spaced from the first housing surface. The latch arm has a mating connector latching end and a disengaging end. A mounting portion extends from the latch arm to the first housing surface. The mounting portion extends from the latch arm between the mating connector latching end and the disengaging end. A first mounting surface of the mounting portion extends at a first angle from the first housing surface in a direction toward the mating connector latching end. The first mounting surface extends from the first latch arm surface at a second angle. The first angle is different than the second angle. The length of the mounting portion as measured between a vertex of the first angle and a vertex of the second angle along the first housing surface is greater than the distance that the first latch arm surface is spaced from the first housing surface. The latch arm is pivotable about the mounting portion. The latch and the mounting portion have low stress concentrations when the latch arm is pivoted about the mounting portion.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
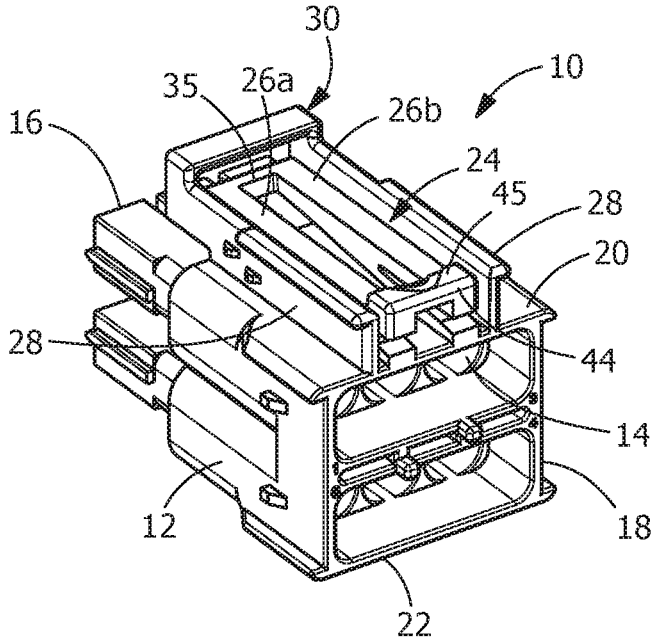
FIG. 1 is a top perspective view of an illustrative electrical connector, showing an illustrative resilient latch of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention.

Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Referring to FIG. 1, an electrical connector 10 has a housing body 12 with one or more contact receiving passages 14 for receiving one or more contacts (not shown). The electrical connector 10 has a forward mating end 16 and a rearward end 18. A first or top surface 20 and an oppositely facing second or bottom surface 22 extend between the mating end 16 and the rearward end 18.

A latch 24 extends from the first or top surface 20 of the housing body 12. The latch 24 has latch arms 26. In the illustrative embodiment shown, the latch 24 is positioned between walls 28 of a shroud 30 which extends from the top surface 20. However, the latch 24 of the present invention may be used with or without a shroud 30.

As best shown in FIGS. 4 through 7, the illustrative latch 24 has two latch arms 26. The latch arms 26 are spaced from each other, with a longitudinal axis of a first latch arm 26*a* extending in a direction which is essentially parallel to a longitudinal axis of a second latch arm 26*b*.

The latch 24 has a mating connector latching end 32 and a disengaging end 34. The latching end 32 has a latching projection 35 which extends between the latch arms 26. A free or first end 36 of the latching projection 35 has a rounded or lead-in surface 38. A back end 40 of the latching projection 35 has a locking shoulder 42 which extends between the latch arms 26.

The disengaging end 34 has a disengaging projection 44 which extends between the latch arms 26. The disengaging projection 44 has a push surface 45.

Each of the latch arms 26 has a first latch arm surface 46 which faces, but is spaced from the first surface 20 of the housing 12. The first latch arm surface 46 extends in a direction which is essentially parallel to the plane of the first surface 20 of the housing 12.

A mounting portion 48 extends from each of the latch arms 26 to the first surface 20 of the housing 12. The mounting portions 48 extend from each latch arm 26 between the mating connector latching end 32 and the disengaging end 34. A first mounting surface 50 of each of the mounting portions 48 extends at a first angle 52 from the first surface 20 of the housing 12 in a direction toward the mating connector latching end 32. The first angle 52, as measured from the first surface 20 of the housing 12 nearer the mating end 16 of the housing 12, is less than 90 degrees. The first mounting surface 50 extends from the first latch arm surface 46 at a second angle 54. The second angle 54, as measured from the first latch arm surface 46 nearer the mating connector latching end 32, is greater than 90 degrees. The first angle 52 is different than the second angle 54. For example, the first angle 52 may be between 5 degrees and 10 degrees and the second angle 54 may be between 170 degrees and 175 degrees.

A second mounting surface 56 of each of the mounting portions 48 extends at a third angle 58 from the first surface 20 of the housing 12 in a direction toward the mating connector latching end 32. The third angle 58, as measured from the first surface 20 of the housing 12 nearer the mating end 16 of the housing 12, is less than 90 degrees. In the illustrative embodiment shown, the third angle 58 is greater than the first angle 52. However, other relative sizes of the angles may be used. For example, the third angle may be between 5 degrees and 15 degrees.

The second mounting surface 56 of each of the mounting portions 48 extends at a fourth angle 60 from the first latch arm surface 46. The fourth angle 60, as measured from the first latch arm surface 46 nearer the mating connector latching end 32, is greater than 90 degrees. In the illustrative embodiment shown, the fourth angle 60 is less than the second angle 54. However, other relative sizes of the angles may be used. For example, the fourth angle 60 may be between 165 degrees and 175 degrees.

The length 62 of each of the mounting portions 48 as measured between a vertex 64 of the first angle 52 and a vertex 66 of the second angle 54 along the first surface 20 of the housing 12 is greater than the distance 68 the first latch arm surface 46 is spaced from the first surface 20 of the housing 12. The vertex 64 of the first angle 52 has a radiused profile. The vertex 66 of the second angle 54 has a radiused profile.

In the illustrative embodiment shown, the latch arms 26 and the mounting portions 48 are made from material with an elongation to break ratio equal to or less than 2.5 percent, such as for example, between 2.0 and 2.2 percent. The stain ratio of the latch arms 26, as defined by the ratio of the maximum strain of the latch arms 26 and mounting portions 48 to the deflection of the disengaging end 34 of the latch arms 26, is equal to or less than 3.5, such as for example, between 3.2 and 3.4. The deflection ratio of the latch arms 26, as defined by the ratio of the deflection of the mating connector latching end 32 of the latch arms 26 to the deflection of the disengaging end 34 of the latch arms 26, is equal to or greater than 2.2, such as for example between 2.2 and 2.4.

The configuration of the housing 12, latch arms 26 and mounting portions 48 minimizes the strain found in the mounting portions 48 and the latch arms 26. This allows the mounting portions 48 and latch arms 26 to be used with miniature connectors and connectors made of brittle plastic material over many cycles without failing. Such material includes, but is not limited to, plastic with high (30% or higher) glass or mineral content. Consequently, the latch arms 26 and the mounting portions 48 do not fail when engaged as the latch arms 26 and the mounting portions 48 have low stress concentrations when depressed.

Contrary to known vertical latches which have very high stress concentrations which leads to micro-cracks at the pivot points, the angled configuration of the mounting portions 48 of the latch arms 26 of the latch 24 of the present invention causes minimal or reduced stresses at the pivot points or vertexes 64, 66 thereby reducing or eliminating micro-cracking, allowing the latch 24 to be used over many cycles. The angled configuration of the mounting portions 48 also provide very low push to release force and a high lift to push ration, thereby enhancing the ergonomics of the latch 24.

Figure 2:
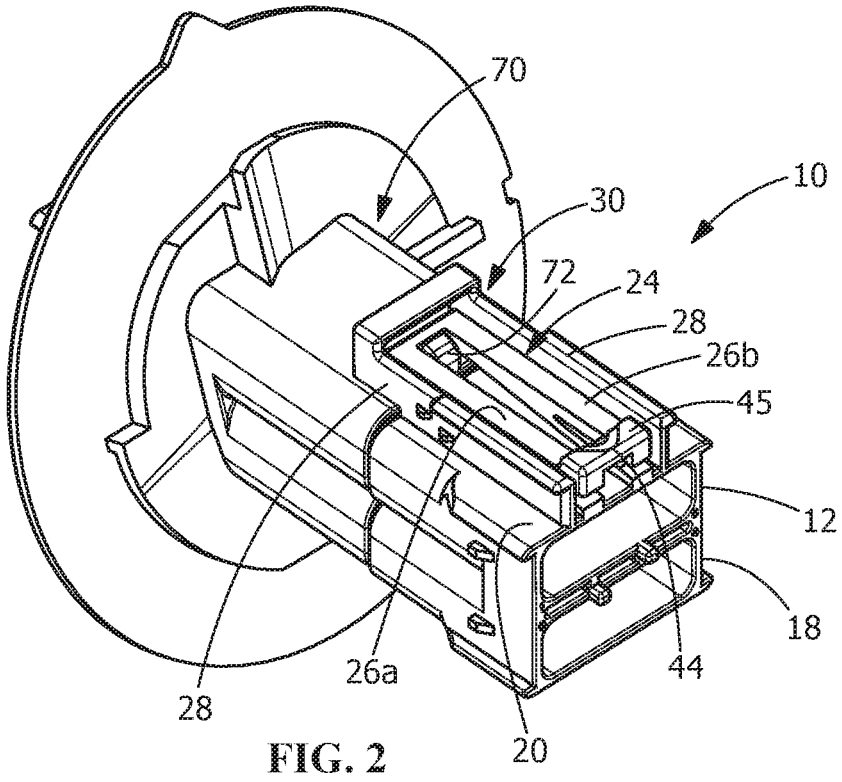
FIG. 2 is a top perspective view of the electrical connector of FIG. 1 mated with an illustrative mating electrical connector.
Figure 3:
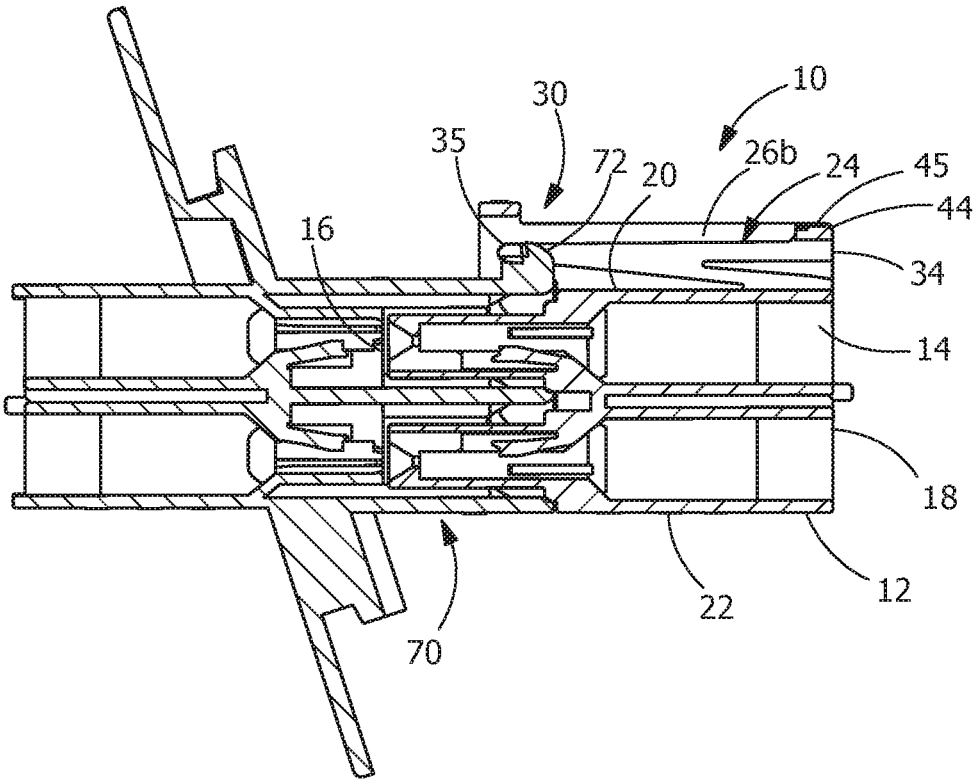
FIG. 3 is a cross-sectional view of the electrical connector and the mating electrical connector of FIG. 2.
Figure 4:
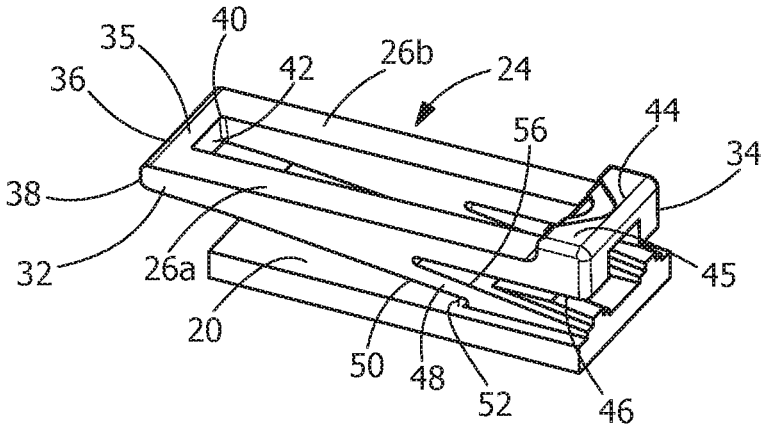
FIG. 4 is a top perspective view of the resilient latch of the electrical connector mounted on a top or first surface of a housing of the electrical connector.

Referring to FIGS. 2 and 3, the latch 24 is used to latch and secure a mating connector 70 to the connector 10. When fully mated the latching projection 35 of the latch 24 engages a latching projection 72 of the mating connector 70 to secure the electrical connector 10 to the mating connector 70.

Figure 5:
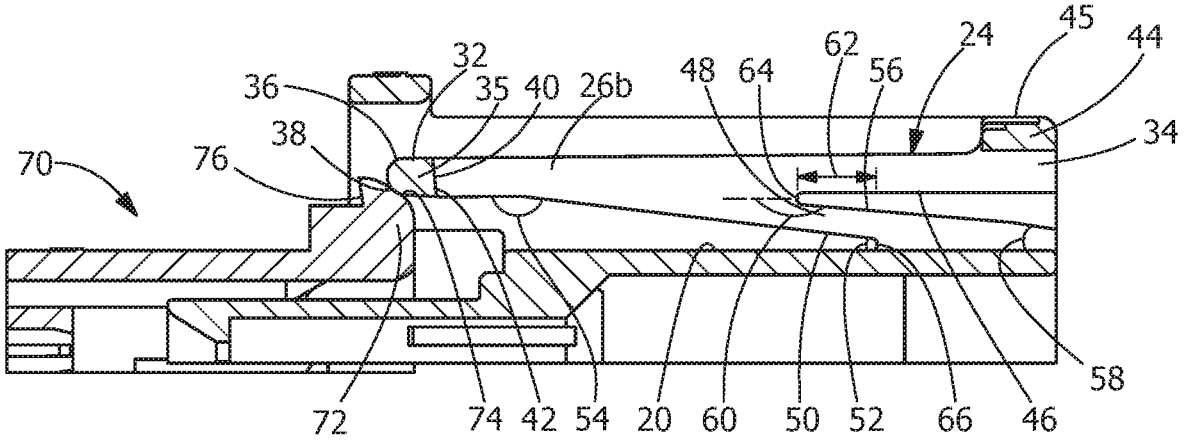
FIG. 5 is a partial cross-sectional view showing the resilient latch of the electrical connector and a locking projection of the mating connector in an unmated position.

As shown in FIG. 5, a respective latch arm 26 of the latch 24 is shown prior to the mating connector 70 and connector 10 being mated together. In this position, the latch arm 26 is in an unstressed position and the mounting portion 48 is not stressed, as no forces are applied to the latch arm 26 or the mounting portion 48.

Figure 6:
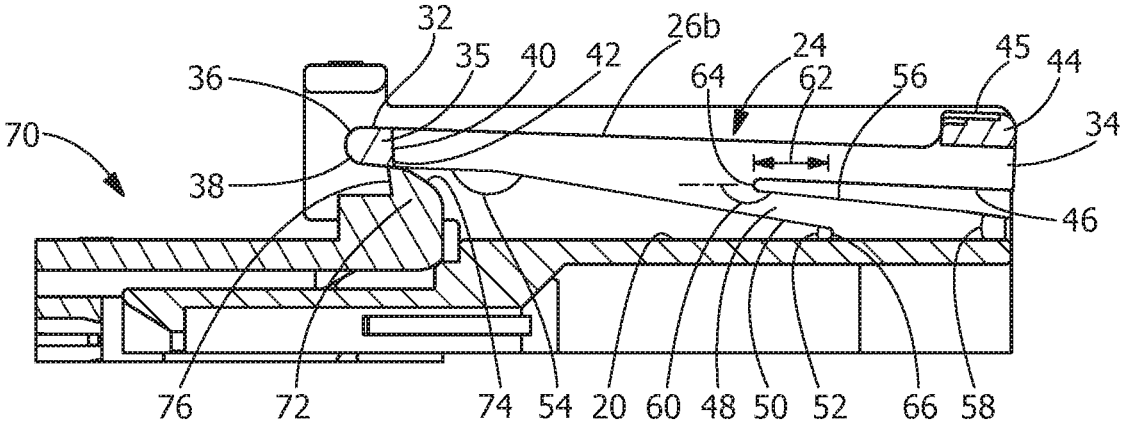
FIG. 6 is a partial cross-sectional view, similar to that of FIG. 5, showing the resilient latch of the electrical connector and the locking projection of the mating connector as the electrical connector and the mating connector are moved from the unmated position to a mated position.

As the mating connector 70 and connector 10 are moved toward the mating position, as shown in FIG. 6, a lead-in surface 74 of the latching projection 72 of the mating connector 70 engages the lead-in surface 38 of the latching projection 35 of the latch arm 26, causing the mating connector latching end 32 and the latch arm 26 to pivot about the mounting portion 48. As previously discussed, the configuration of the mounting portion 48 minimizes the strain found in the mounting portions 48 and the latch arms 26 as the latch arms 26 are moved or pivoted, causing only low stress concentrations when the latch arms 26 are moved or pivoted.

Figure 7:
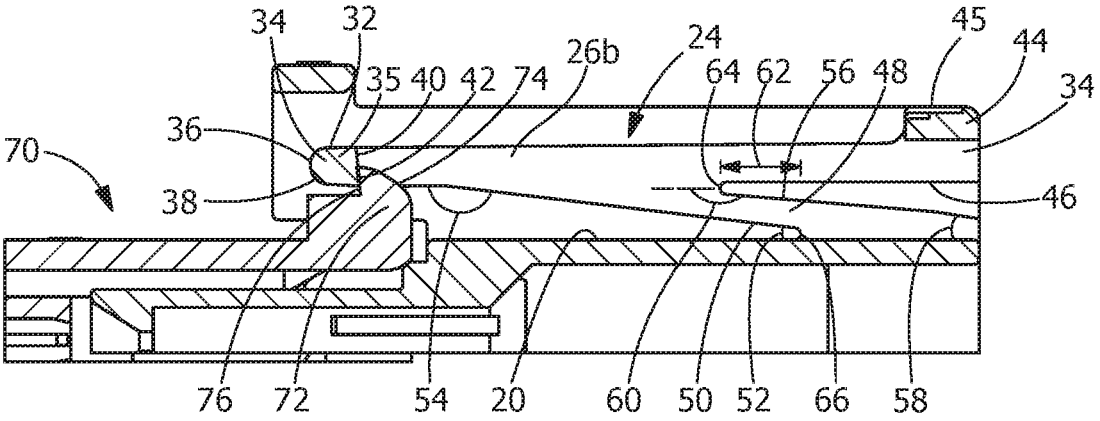
FIG. 7 is a partial cross-sectional view, similar to that of FIG. 5, showing the resilient latch of the electrical connector and the locking projection of the mating connector in the mated position

With the connector 10 properly mated with the mating connector 70, the lead-in surface 38 of the latching projection 35 of the latch arm 26 is moved passed the lead-in surface 74 of the latching projection 72 of the mating connector 70, as shown in FIG. 7, allowing the latch arm 26 to return toward its original or unstressed position. In this position, a locking shoulder 76 of the latching projection 72 engages the locking shoulder 42 of the latching projection 35 to maintain and secure the mating connector 70 in the connector 10.

In order to disengage the connector 10 from the mating connector 70, the disengaging projection 44 of the disengaging end 34 of the latch 24 is depressed, causing the mating connector latching end 32 and the latch arm 26 to pivot about the mounting portion 48, similar to that shown in FIG. 6. This results in the locking shoulder 42 of the latching projection 35 being moved out of engagement with the locking shoulder 76 of the latching projection 72, allowing the unmating of the connector 10 from the mating connector 70. As previously discussed, the configuration of the mounting portion 48 minimizes the strain found in the mounting portions 48 and the latch arms 26 as the latch arms 26 are moved or pivoted, causing only low stress concentrations when the latch arms 26 are moved or pivoted. In addition, the angled configuration of the mounting portions 48 provides very low push to release force and a high lift to push ration, thereby enhancing the ergonomics of the latch 24 as the disengaging projection 44 is depressed.

One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a housing having a first housing surface;

a latch extending from the first housing surface of the housing, the latch having a latch arm with a first latch arm surface which faces, but is spaced from the first housing surface, the latch arm having a mating connector latching end and a disengaging end;

a mounting portion extending from the latch arm to the first housing surface, the mounting portion extending from the latch arm between the mating connector latching end and the disengaging end, a first mounting surface of the mounting portion extending at a first angle from the first housing surface in a direction toward the mating connector latching end, the first angle, as measured from the first housing surface nearer a mating end of the housing, is less than 90 degrees, the first mounting surface extending from the first latch arm surface at a second angle, the second angle, as measured from the first latch arm surface nearer the mating connector latching end, is greater than 90 degrees, a second mounting surface of the mounting portion extends at a third angle from the first housing surface in a direction toward the mating connector latching end, the third angle, as measured from the first housing surface nearer a mating end of the housing, is less than 90 degrees, the third angle is greater than the first angle.

2. The electrical connector as recited in claim 1, wherein the second mounting surface of the mounting portion extends at a fourth angle from the first latch arm surface, the fourth angle, as measured from the first latch arm surface nearer a mating connector latching end, is greater than 90 degrees, the fourth angle is less than the second angle.

3. The electrical connector as recited in claim 1, wherein the housing, latch and mounting portion are made from material with an elongation to break ratio equal to or less than 2.5 percent.

4. The electrical connector as recited in claim 1, wherein the length of the mounting portion as measured between a vertex of the first angle and a vertex of the second angle along the first housing surface is greater than the distance that the first latch arm surface is spaced from the first housing surface.

5. The electrical connector as recited in claim 4, wherein the vertex of the first angle has a radiused profile.

6. The electrical connector as recited in claim 4, wherein the vertex of the second angle has a radiused profile.

7. The electrical connector as recited in claim 1, wherein the latch has two latch arms which are spaced from each other, a first latch arm of the latch arms extends in a direction which is essentially parallel to a second latch arm of the latch arms.

8. The electrical connector as recited in claim 7, wherein a latching projection extends between the latch arms proximate the mating connector latching ends of the latch arms.

9. The electrical connector as recited in claim 1, wherein the strain ratio of the latch arm as defined by the ratio of the maximum strain of the latch arm and mounting portion to the deflection of the disengaging end of the latch arm is equal to or less than 3.5.

10. The electrical connector as recited in claim 1, wherein the deflection ratio of the latch arm as defined by the ratio of the deflection of the mating connector latching end of the latch arm to the deflection of the disengaging end of the latch arm is equal to or greater than 2.2.

11. An electrical connector comprising a housing having a first housing surface;

a latch extending from the first housing surface of the housing, the latch having two latch arms with first latch arm surfaces which face, but are spaced from the first housing surface, the latch arms having mating connector latching ends and disengaging ends, the latch arms which being spaced from each other, a first latch arm of the latch arms extending in a direction which is essentially parallel to a second latch arm of the latch arms, a latching projection extending between the latch arms proximate the mating connector latching ends of the latch arms;

a mounting portion extending from the latch arm to the first housing surface, the mounting portion extending from the latch arm between the mating connector latching end and the disengaging end, a first mounting surface of the mounting portion extending at a first angle from the first housing surface in a direction toward the mating connector latching end, the first mounting surface extending from the first latch arm surface at a second angle, the first angle being different than the second angle, a length of the mounting portion as measured between a vertex of the first angle and a vertex of the second angle along the first housing surface is greater than the distance that the first latch arm surface is spaced from the first housing surface.

12. The electrical connector as recited in claim 11, wherein the first angle, as measured from the first housing surface nearer a mating end of the housing, is less than 90 degrees, and the second angle, as measured from the first latch arm surface nearer a mating connector latching end, is greater than 90 degrees.

13. The electrical connector as recited in claim 11, wherein the housing, latch and mounting portion are made from material with an elongation to break ratio equal to or less than 2.5 percent.

14. The electrical connector as recited in claim 11, wherein the length of the mounting portion as measured between a vertex of the first angle and a vertex of the second angle along the first housing surface is greater than the distance that the first latch arm surface is spaced from the first housing surface.

15. The electrical connector as recited in claim 14, wherein the vertex of the first angle has a radiused profile.

16. The electrical connector as recited in claim 14, wherein the vertex of the second angle has a radiused profile.

17. The electrical connector as recited in claim 11, wherein the strain ratio of the latch arm as defined by the ratio of the maximum strain of the latch arm and mounting portion to the deflection of the disengaging end of the latch arm is equal to or less than 3.5.

18. The electrical connector as recited in claim 11, wherein the deflection ratio of the latch arm as defined by the ratio of the deflection of the mating connector latching end of the latch arm to the deflection of the disengaging end of the latch arm is equal to or greater than 2.2.

19. An electrical connector comprising:

a housing having a first housing surface;

a latch extending from the first housing surface of the housing, the latch having a latch arm with a first latch arm surface which faces, but is spaced from the first housing surface, the latch arm having a mating connector latching end and a disengaging end;

a mounting portion extending from the latch arm to the first housing surface, the mounting portion extending from the latch arm between the mating connector latching end and the disengaging end, a first mounting surface of the mounting portion extending at a first angle from the first housing surface in a direction toward the mating connector latching end, the first angle, as measured from the first housing surface nearer a mating end of the housing, is less than 90 degrees, the first mounting surface extending from the first latch arm surface at a second angle, the second angle, as measured from the first latch arm surface nearer the mating connector latching end, is greater than 90 degrees;

the housing, latch and mounting portion are made from material with an elongation to break ratio equal to or less than 2.5 percent.

20. The electrical connector as recited in claim 19, wherein the strain ratio of the latch arm as defined by the ratio of the maximum strain of the latch arm and mounting portion to the deflection of the disengaging end of the latch arm is equal to or less than 3.5.

21. The electrical connector as recited in claim 19, wherein the deflection ratio of the latch arm as defined by the ratio of the deflection of the mating connector latching end of the latch arm to the deflection of the disengaging end of the latch arm is equal to or greater than 2.2.

* * * * *